US007084820B2

(12) United States Patent
Noro et al.

(10) Patent No.: US 7,084,820 B2
(45) Date of Patent: Aug. 1, 2006

(54) ANTENNA DEVICE HAVING EXCELLENT HORIZONTAL AND VERTICAL POLARIZATION CHARACTERISTICS

(75) Inventors: Junichi Noro, Akita (JP); Kenichi Kamada, Akita (JP); Akira Miyoshi, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/068,687

(22) Filed: Feb. 28, 2005

(65) Prior Publication Data

US 2006/0001579 A1 Jan. 5, 2006

(30) Foreign Application Priority Data

Jun. 30, 2004 (JP) ..... 2004-192906
Sep. 29, 2004 (JP) ..... 2004-284223

(51) Int. Cl.
*H01Q 1/24* (2006.01)

(52) U.S. Cl. ..... 343/702; 343/700 MS; 343/905; 343/795

(58) Field of Classification Search ..... 343/702, 343/700 MS
See application file for complete search history.

(56) References Cited

U.S. PATENT DOCUMENTS

| | | | | |
|---|---|---|---|---|
| 4,661,992 | A * | 4/1987 | Garay et al. | 455/90.3 |
| 6,677,905 | B1 * | 1/2004 | Deguchi et al. | 343/702 |
| 6,686,886 | B1 * | 2/2004 | Flint et al. | 343/702 |
| 6,954,178 | B1 * | 10/2005 | Winter | 343/700 MS |
| 2002/0158808 | A1 * | 10/2002 | Inoue | 343/795 |
| 2004/0017318 | A1 * | 1/2004 | Annabi et al. | 343/702 |
| 2005/0110698 | A1 * | 5/2005 | Surducan et al. | 343/795 |
| 2005/0168384 | A1 * | 8/2005 | Wang et al. | 343/700 MS |

FOREIGN PATENT DOCUMENTS

JP 2003-338708 A 11/2003

* cited by examiner

*Primary Examiner*—Hoang V. Nguyen
*Assistant Examiner*—Binh Van Ho
(74) *Attorney, Agent, or Firm*—Frishauf, Holtz, Goodman & Chick, P.C.

(57) ABSTRACT

An antenna device comprises a coaxial cable that has a central conductor and an outer conductor and is folded into an L-shape at an end portion. An L-shaped first-conductor-portion is electrically connected to the central conductor at the end portion of the coaxial cable. An L-shaped second-conductor-portion is electrically connected to the outer conductor at the end portion of the coaxial cable and is disposed along an outer circumferential face of the coaxial cable. The first and second conductor portions as a whole are formed into an approximate U-shape.

7 Claims, 7 Drawing Sheets

ANTENNA DEVICE HAVING EXCELLENT HORIZONTAL AND VERTICAL POLARIZATION CHARACTERISTICS

This application claims priority to prior Japanese patent applications JP 2004-192906 and JP 2004-284223, the disclosures of which are incorporated herein by reference.

BACKGROUND OF THE INVENTION

The present invention relates to an antenna device and, particularly, to a sleeve antenna.

As is commonly known, the sleeve antenna is a coaxial vertical-antenna, and a single, vertical half-wave radiator. The sleeve antenna does not have horizontal directivity. Such a sleeve antenna is used for eliminating coupling of a feeder with the antenna.

FIG. 1 shows an aspect of a sleeve antenna 1. The sleeve antenna 1 comprises a lower half 2 and an upper radiant-section 3. The lower half 2 is a metal sleeve through which a feeder 4 concentrically passes. As the feeder 4, a coaxial cable is used. The radiant section 3 has a length of quarter wavelength ($\lambda/4$), and is connected to a central conductor of the feeder 4.

When the coaxial cable is used as the feeder, a central conductor itself of the coaxial cable can be used as the radiant section 3. An outer conductor of the coaxial cable is electrically connected to the metal sleeve 2 by solder.

The following antenna device, while it is not the sleeve antenna, is known as a related art of the invention. Japanese Unexamined Patent Application Publication (JP-A) No. 2003-338708 discloses a small-size, lightweight, and inexpensive antenna device that can resonate with both of two types of wavelengths, $\lambda 1$ and $\lambda 2$.

As above, since the sleeve antenna does not have the horizontal directivity, it can exhibit certain horizontal polarization characteristics. However, there has been a problem of considerably degraded vertical-polarization-characteristics in the sleeve antenna.

SUMMARY OF THE INVENTION

Therefore, the present invention intends to provide an antenna device in which the vertical polarization characteristics can be improved in addition to the horizontal polarization characteristics.

An antenna device according to a first aspect of the present invention comprises a coaxial cable that has a central conductor and an outer conductor and is folded into an L-shape at an end portion. An L-shaped first-conductor-portion is electrically connected to the central conductor at the end portion of the coaxial cable. An L-shaped second-conductor-portion is electrically connected to the outer conductor at the end portion of the coaxial cable and is disposed along an outer circumferential face of the coaxial cable. The first and second conductor portions as a whole are formed into an approximate U-shape.

In the antenna device according to the first aspect, the first conductor portion may be formed by exposing the central conductor of the coaxial cable by a predetermined length and folding the central conductor into the L-shape.

In the antenna device according to the first aspect, the second conductor may comprise an L-shaped metal-sleeve which covers the outer circumferential face of the end portion of the coaxial cable.

Alternatively, the coaxial cable may be disposed on a substrate, and the first conductor portion may be formed from an L-shaped first-wiring-pattern formed on the substrate, and the second conductor portion may be formed from an L-shaped second-wiring-pattern formed on the substrate.

An antenna device according to a second aspect of the present invention comprises a substrate, an L-shaped first-wiring-pattern formed on the substrate, an L-shaped second-wiring-pattern which has an end opposed to an end of the first wiring pattern with clearance and is formed such that it forms an approximate U-shape on the substrate together with the first wiring pattern. The antenna device also comprises an L-shaped ground-pattern which has one end electrically connected to the end of the second wiring pattern and is formed inside the second wiring pattern with a space and along the second wiring pattern on the substrate. The antenna device further comprises an L-shaped signal-pattern which has one end electrically connected to the end of the first wiring pattern and is formed inside the ground pattern with a space and along the ground pattern on the substrate.

The antenna device according to the second aspect may still further comprise a coaxial cable having a central conductor and an outer conductor. In the case, at an end of the coaxial cable, the central conductor is connected to the other end of the signal pattern, and the outer conductor is connected to the other end of the ground pattern.

BRIEF DESCRIPTION OF THE DRAWING

FIGS. 6A to 6C are views showing an antenna device according to a second embodiment of the present invention, wherein FIG. 6A is a plan view, FIG. 6B is a right side view, and FIG. 6C is a rear view;

DESCRIPTION OF THE PREFERRED EMBODIMENTS

Figure 1:
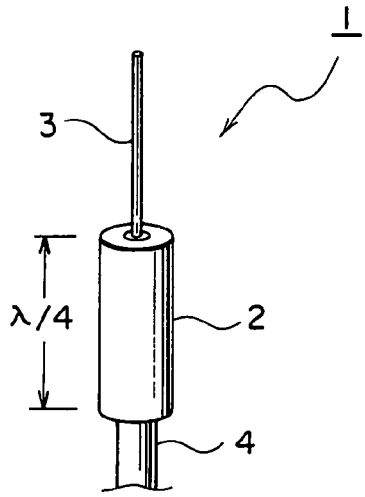
FIG. 1 PRIOR ART
FIG. 1 is a perspective view showing a configuration of a conventional sleeve antenna.

An antenna device 10 according to a first embodiment of the present invention is described with reference to FIG. 2. The antenna device 10 employs a coaxial cable 20 shown in FIG. 3 as a feeder 12. As shown in FIG. 3, the coaxial cable 20 is an electric-signal transmission medium having a coaxial form, which includes a cylindrical outer-conductor 21 and a central conductor 22. A cylindrical insulator 23 insulates between the outer conductor 21 and the central conductor 22. The outer conductor 21 is covered with a sheath 24.

The sheath 24, outer conductor 21, and insulator 23 of the coaxial cable are cut out to thus expose only the central conductor 22 by a distance $L_1$, and the exposed central conductor 22 is made to be a radiant section 14 of the antenna device 10. That is, in the embodiment, the radiant section 14 is formed from the central conductor 22 of the coaxial cable 20.

On the other hand, a metal sleeve 16 having a length of $L_2$ is put over an outer circumference of the feeder 12 (coaxial cable 20). The metal sleeve 16 is electrically connected to the outer conductor 21 of the coaxial cable 20 by solder. The shown metal sleeve 16 is made of copper.

Figure 2:
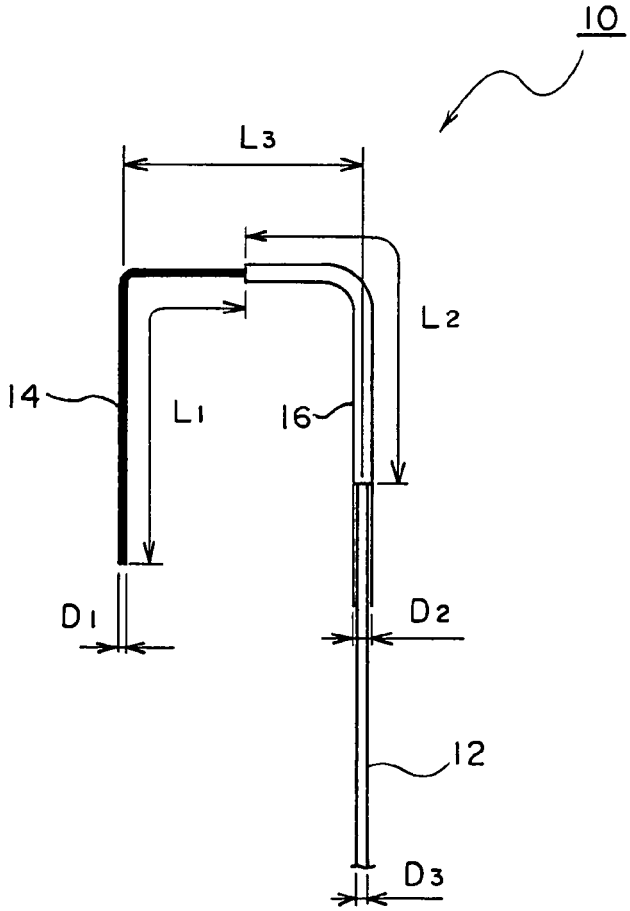
FIG. 2 is a plan view of an antenna device according to a first embodiment of the present invention.
Figure 3:
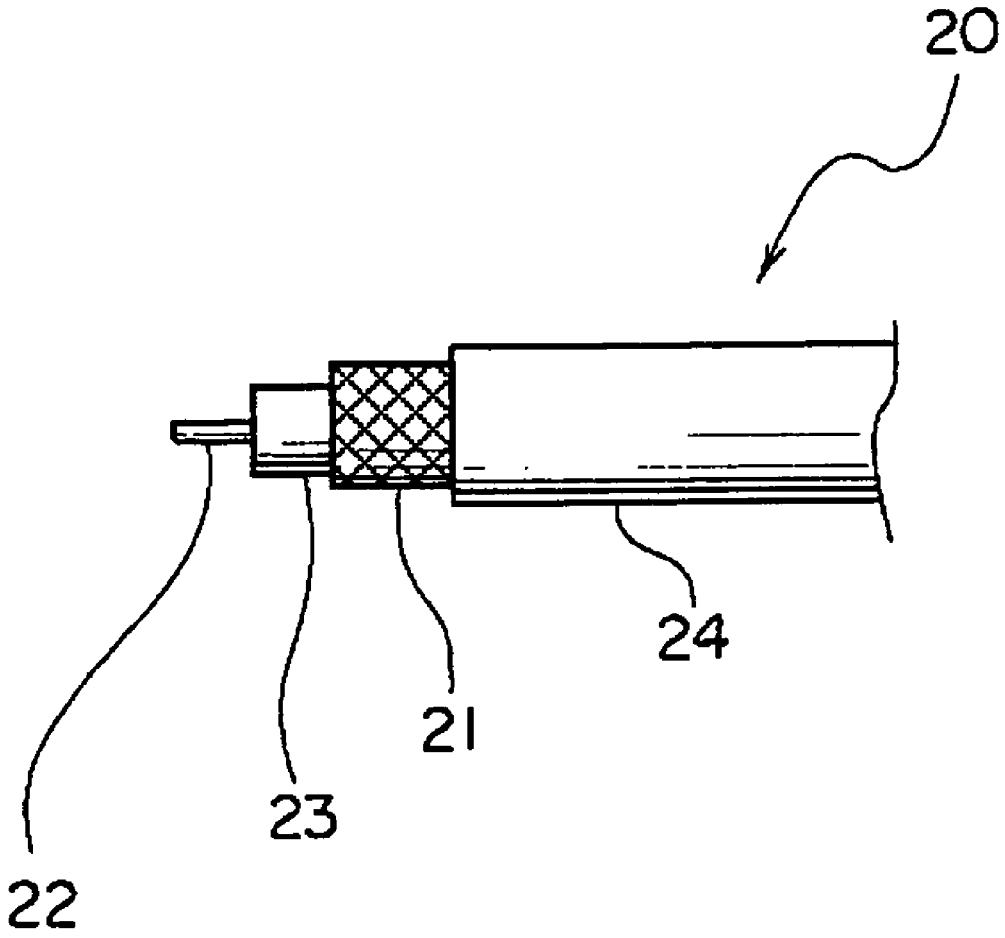
FIG. 3 is a front view showing a coaxial cable used as a feeder of the antenna device shown in FIG. 2.

As shown in FIG. 2, the metal sleeve 16 (second conductor portion) is folded halfway at right angles, thereby formed into an L-shape. The radiant section 14 (central conductor 22 as a first conductor portion) is also folded halfway at right angles, thereby formed into the L-shape. The L-shaped metal sleeve 16 and the L-shaped radiant section 14 are generally formed into an approximately U-shape.

In the shown embodiment, the length $L_1$ of the radiant section 14 is 30.5 mm, and the length $L_2$ of the metal sleeve 16 is 24 mm. A distance $L_3$ between a folding point of the metal sleeve 16 and a folding point of the radiant section 14 is 17.9 mm. Diameter $D_1$ of the radiant section 14 is 0.4 mm, and outer diameter $D_2$ of the metal sleeve 16 is 1.4 mm. Outer diameter $D_3$ of the feeder 12 (coaxial cable 20) is 0.8 mm.

The antenna device 10 has resonance frequency of 2.456 GHz within a frequency range used in wireless LAN (Local Area Network).

In the antenna device 10 having such a structure, the vertical polarization characteristics can be improved in addition to the horizontal polarization characteristics unlike the conventional sleeve antenna 1 shown in FIG. 1.

Figure 4:
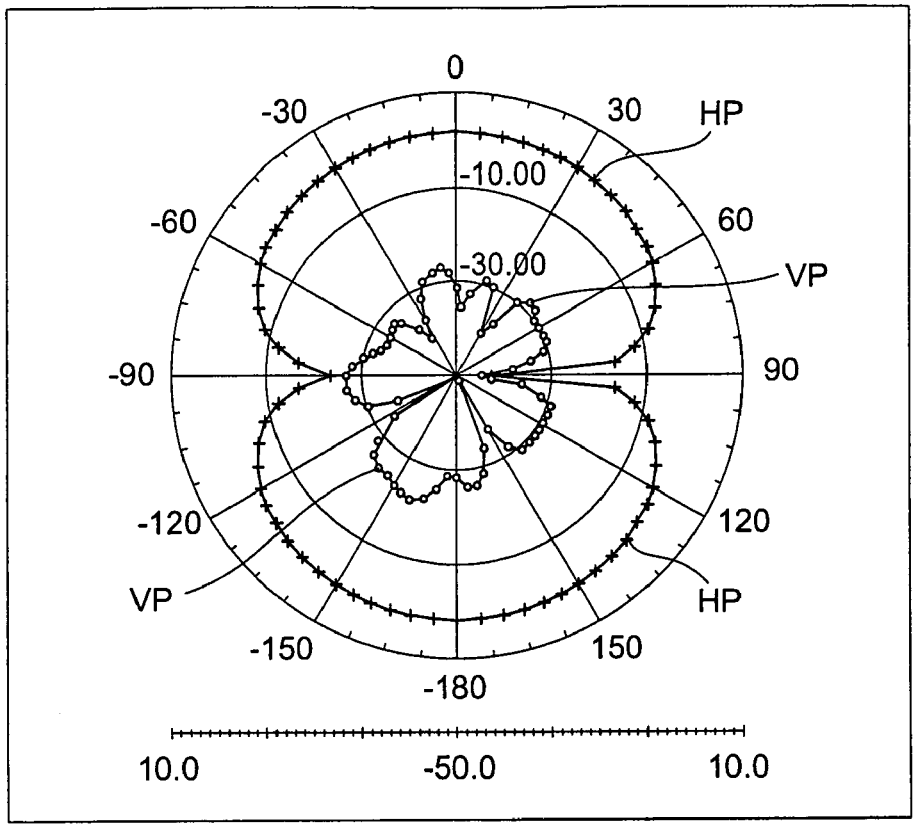
FIG. 4 is a characteristic diagram showing radiation-pattern characteristics of the conventional sleeve antenna.
Figure 4:
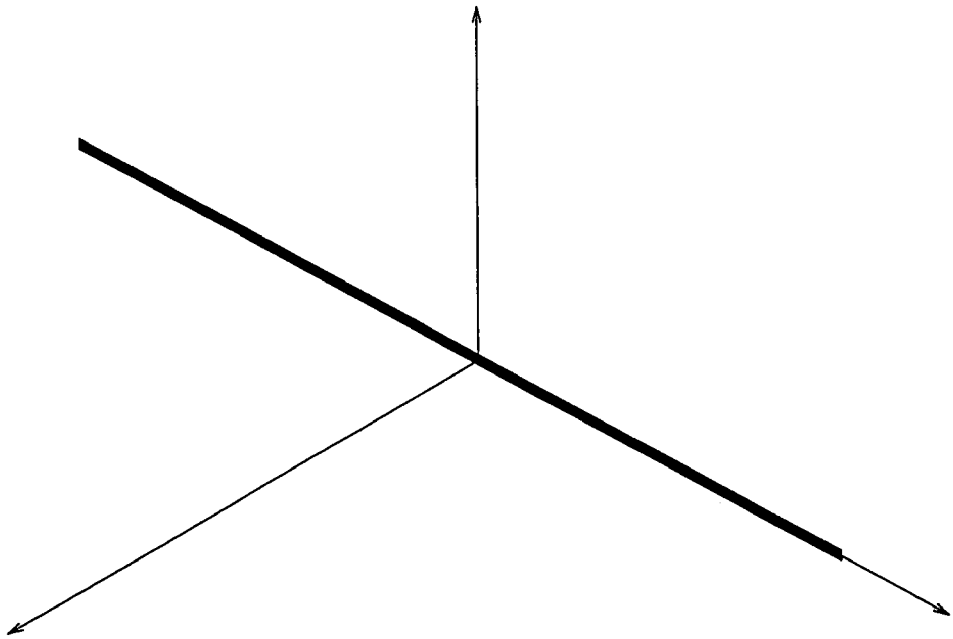
Figure 5:
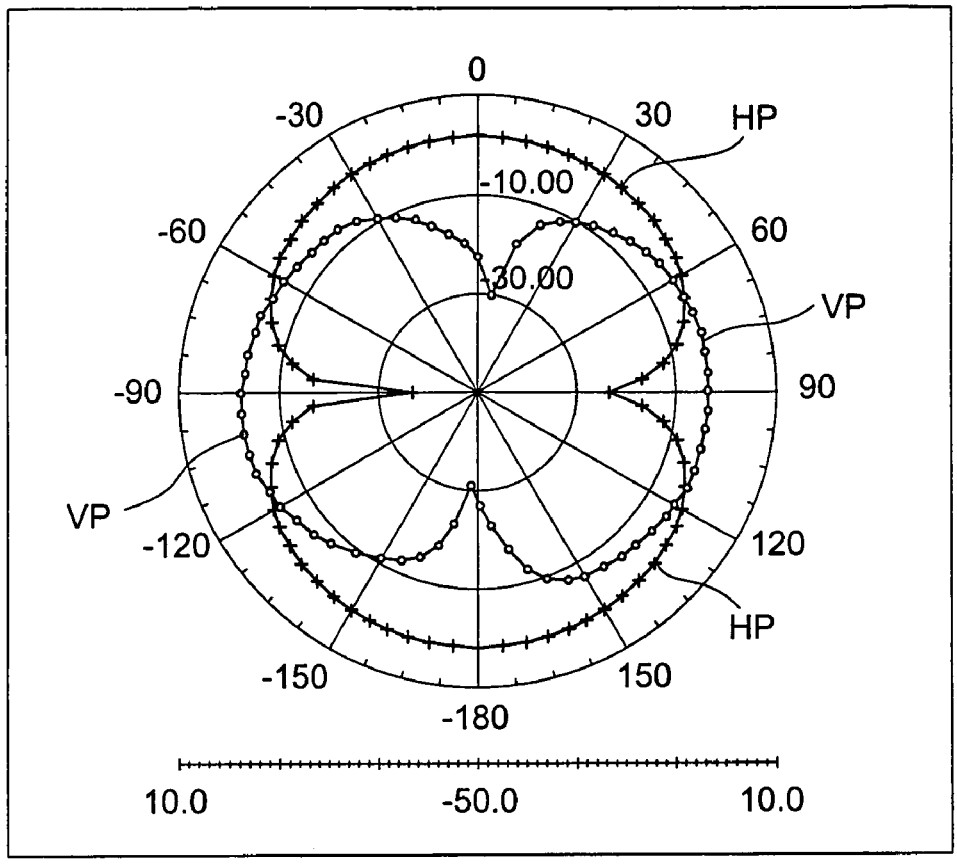
FIG. 5 is a characteristic diagram showing radiation-pattern characteristics of the sleeve antenna according to the present invention.
Figure 5:
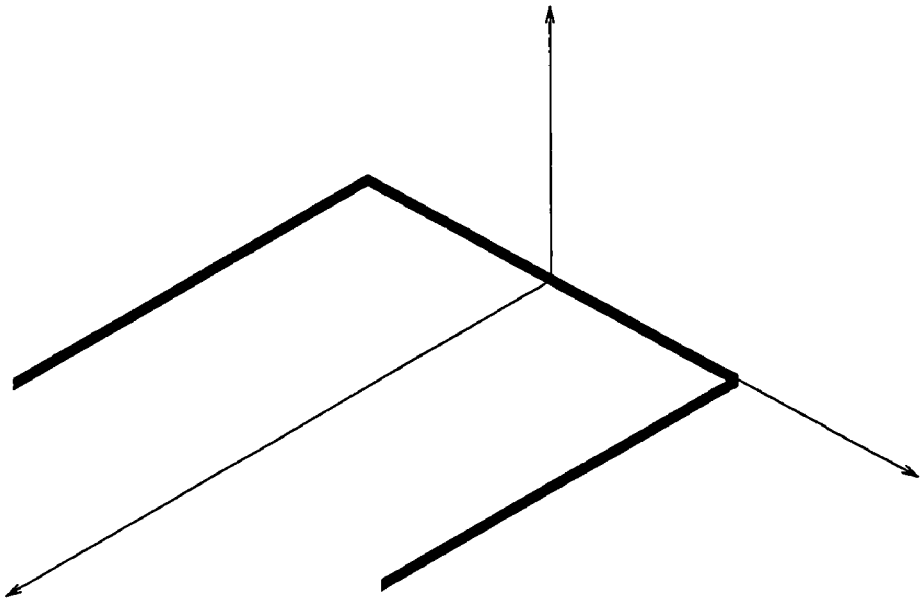

FIG. 4 shows radiation pattern characteristics of the conventional sleeve antenna 1, and FIG. 5 shows radiation pattern characteristics of the antenna device 10 according to the present invention. In FIG. 4 and FIG. 5, HP shows the horizontal polarization characteristic, and VP shows the vertical polarization characteristic.

As shown in FIG. 4, in the conventional sleeve antenna 1, while the horizontal polarization characteristic HP is sufficiently obtained, the vertical polarization characteristic VP is not sufficiently obtained. On the contrary, as shown in FIG. 5, in the antenna device 10 according to the present invention, it is found that both the horizontal polarization characteristic HP and the vertical polarization characteristic VP are sufficiently obtained.

An antenna device 10A according to a second embodiment of the present invention is described with reference to FIG. 6A to FIG. 6C. The antenna device 10A has the same configuration as the antenna device 10 shown in FIG. 2 except for using first and second wiring patterns 31 and 32 instead of using the radiant section 14 and the metal sleeve 16 shown in FIG. 2. The first and second wiring patterns 31 and 32 (first and second conductor portions) are formed on a substrate 30 of an insulation material.

Figure 7:
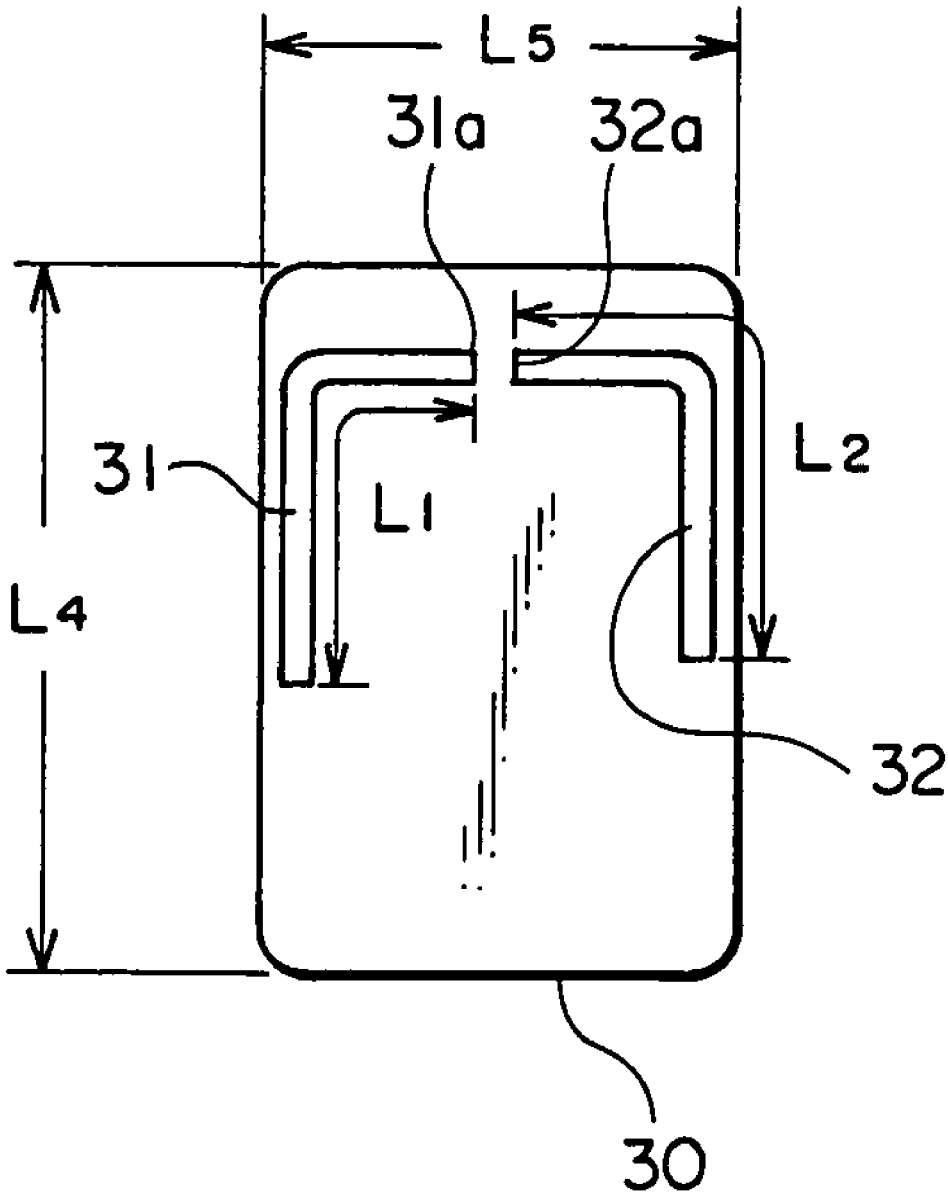
FIG. 7 is a plan view showing a substrate used in the antenna device shown in FIG. 6.

FIG. 7 shows the substrate 30 on which the first and second wiring patterns 31 and 32 are formed. The substrate 30 is in the shape of rectangle having a longitudinal size $L_4$ and a lateral size $L_5$. The first wiring pattern 31 has a length of $L_1$ and is formed into the L-shape. The second wiring pattern 32 has a length of $L_2$ and is formed into the L-shape. As shown in FIG. 7, the first wiring pattern 31 and the second wiring pattern 32 are disposed such that they form the approximately U-shape with a gap between respective ends 31*a* and 32*a*.

In the shown embodiment, the length $L_1$ of the first wiring pattern 31 is 26.5 mm, and the length $L_2$ of the second wiring pattern 32 is 26 mm. The longitudinal size $L_4$ of the substrate 30 is 35 mm, and the lateral size $L_5$ of the substrate is 23 mm.

Figure 6C:
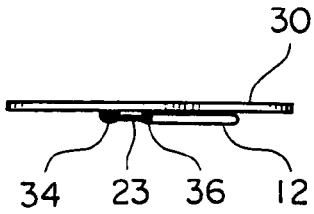
Figure 6A:
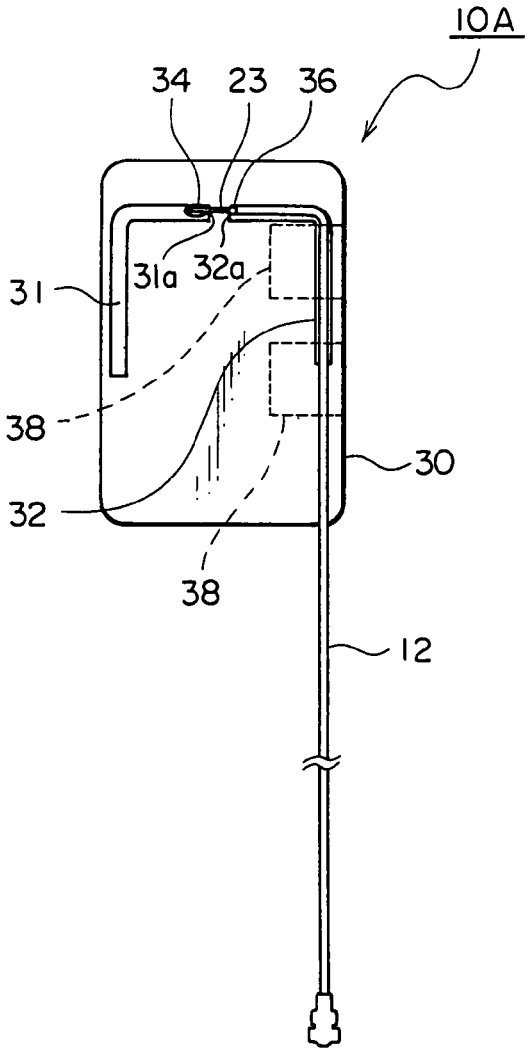
Figure 6B:
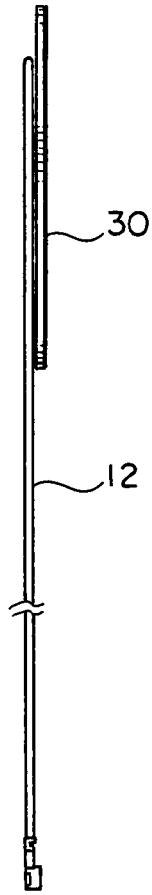

As shown in FIG. 6A to FIG. 6C, the feeder 12 (coaxial cable 20) is mounted on the substrate 30 along the second wiring pattern 32. The central conductor (22 in FIG. 3) of the feeder 12 (coaxial cable 20) is electrically connected to the first wiring pattern 31 at an end 31*a* of the pattern by solder 34. The outer conductor (21 in FIG. 3) of the feeder 12 (coaxial cable 20) is electrically connected to the second wiring pattern 32 at an end 32*a* of the pattern by solder 36. The insulator 23 (refer to FIG. 3) of the feeder 12 (coaxial cable 20) lies between the end 31*a* of the first wiring pattern 31 and the end 32*a* of the second wiring pattern 32. The feeder 12 is fixed to a predetermined position on the substrate 30 using an adhesive tape 38.

In the antenna device 10A having such a configuration, the first pattern 31 serves as the radiant section 14 in FIG. 2, and the second pattern 32 serves as the metal sleeve 16 in FIG. 2. Again in the antenna device 10A, since the conductor portion is generally formed into the approximately U-shape, the vertical polarization characteristic can be improved in addition to the horizontal polarization characteristic.

An antenna device 10B according to a third embodiment of the present invention is described with reference to FIG. 8. The antenna device 10B has the same configuration as the antenna device 10A shown in FIG. 6 except for the following point. Thus, a ground pattern 41 and a signal pattern 42 are formed on the substrate 30 instead of mounting the end portion of the feeder 12 (coaxial cable 20) on the substrate 30 with being folded into the L-shape. As in FIG. 7, the L-shaped first-wiring-pattern 31 and the L-shaped second-wiring-pattern 32 are disposed and formed on the substrate 30 such that they form the approximately U-shape.

The reason for forming the ground pattern 41 and the signal pattern 42 on the substrate 30 is as follows. In the antenna device 10A shown in FIG. 6A, the end portion of the feeder 12 (coaxial cable 20) is mounted on the substrate 30 with being folded into the L-shape. In other words, a sleeve dipole is formed from a printed pattern comprising the first and second wiring patterns 31, 32 and the outer conductor (21 in FIG. 3) of the feeder 12 (coaxial cable 20). Fixing of the end portion of the feeder 12 on the substrate 30 is manually performed. Therefore, if a fixing position of the feeder 12 on the substrate 30 is shifted from the predetermined position, fluctuation in antenna performance may occur. Furthermore, since the end portion of the feeder 12 must be mounted on the substrate 30 with being folded into the L-shape, the antenna device 10A is not easily assembled.

Figure 8:
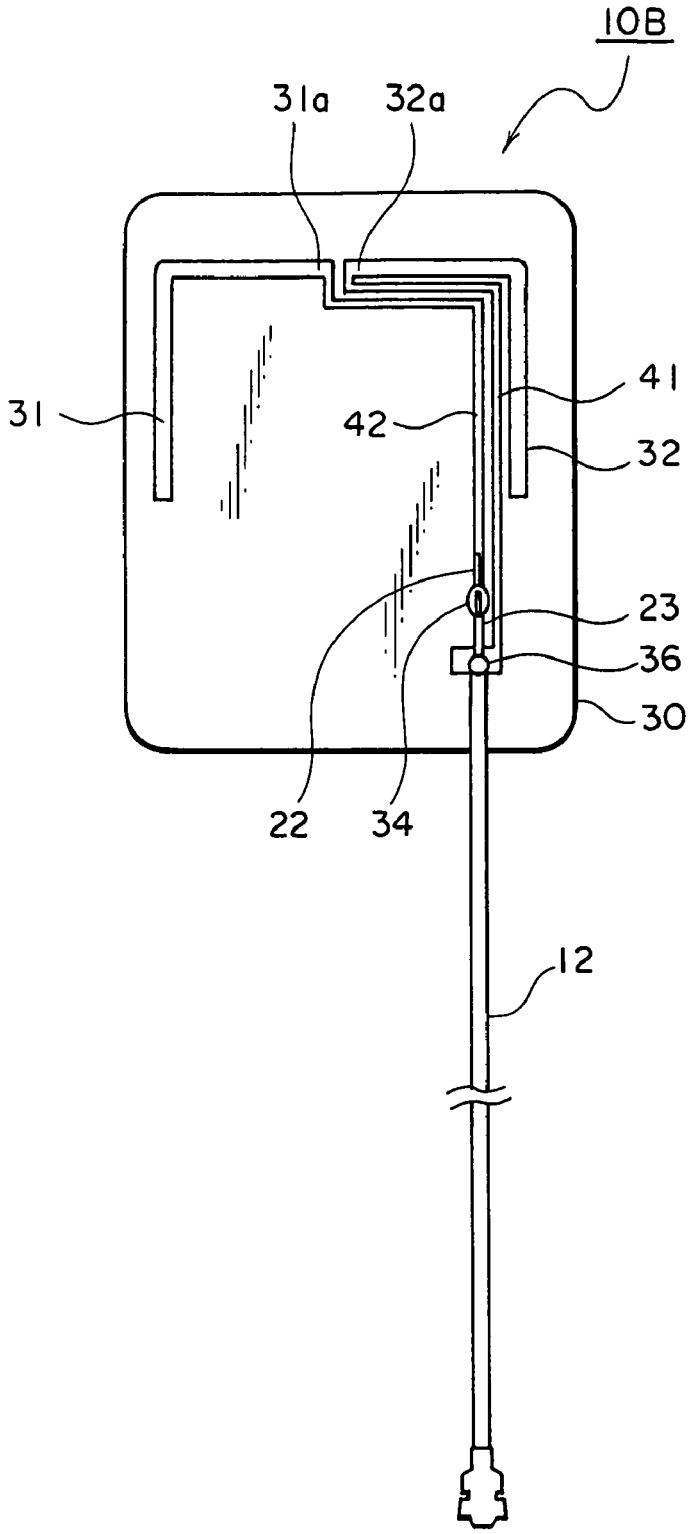
FIG. 8 is a plan view showing an antenna device according to a third embodiment of the present invention.

Thus, in the antenna device 10B shown in FIG. 8, the ground pattern 41 and the signal pattern 42 are formed on the substrate 30 instead of mounting the end portion of the feeder 12 on the substrate 30 with being folded into the L-shape.

In a detailed explanation, the L-shaped first-pattern 31 and the L-shaped second-pattern 32 have ends 31*a* and 32*a* opposed to each other with clearance, respectively. The first wiring pattern 31 and the second wiring pattern 32 are formed substantially symmetrically on the substrate 30. As a result, the first wiring pattern 31 and the second wiring pattern 32 form the approximately U-shape. The ground pattern 41 is also formed into the L-shape, and has one end electrically connected to the end portion 32*a* of the second wiring pattern 32. In addition, the ground pattern 41 is formed on the substrate 30 such that it lies inside the second wiring pattern 32 with a space and along the second wiring pattern 32. The signal pattern 42 is also formed into the L-shape, and has one end electrically connected to the end portion 31*a* of the first wiring pattern 31. In addition, the signal pattern 42 is formed on the substrate 30 such that it lies inside the ground pattern 41 with a space and along the ground pattern 41. At the end portion of the feeder 12, the central conductor (22 in FIG. 3) of the feeder is connected to the other end of the signal pattern 42 by the solder 34. The outer conductor (21 in FIG. 3) of the feeder 12 is electrically connected to the other end of the ground pattern 41 by the solder 36. The insulator (23 in FIG. 3) of the feeder 12 lies between the other end of the ground pattern 41 and the other end of the signal pattern 42.

In this way, in the antenna device 10B according to the third embodiment, a ground side of the sleeve dipole is formed from the printed pattern as the ground pattern 41, rather than the outer conductor (21 in FIG. 3) of the feeder 12 (coaxial cable 20) as shown in FIG. 6A. Accordingly, the antenna device 10B can be easily assembled. Moreover, the feeder 12 need not be precisely fixed to the predetermined position, and the fluctuation due to the shift of the fixing position of the feeder 12 does not occur in the antenna performance, therefore stable antenna performance can be obtained.

Again in the antenna device 10B, since the conductor portion is generally formed into the approximately U-shape, the vertical polarization characteristic can be improved in addition to the horizontal polarization characteristic.

In the antenna device according to the present invention, the coaxial cable is used, and the first conductor portion connected to the central conductor of the coaxial cable is formed into the L-shape, and the second conductor portion connected to the outer conductor of the coaxial cable is also formed into the L-shape. In addition, the first conductor portion and the second conductor portion are generally formed into the approximately U-shape. Thus, according to the antenna device according to the present invention, the vertical polarization characteristic can be improved in addition to the horizontal polarization characteristic.

Hereinbefore, while the present invention has thus far been described according to several preferred embodiments, it will readily be understood that the present invention is not limited to the embodiments. For example, while a case that the central conductor of the coaxial cable or the first wiring pattern formed on the substrate is used as the first conductor portion is described by way of examples, the first conductor portion is not limited thereto. Similarly, while a case that the metal sleeve or the second wiring pattern formed on the substrate is used as the second conductor portion is described by way of examples, the second conductor portion is not limited thereto.

The invention claimed is:

1. An antenna device comprising:

a coaxial cable that has a central conductor and an outer conductor and is folded into an L-shape at an end portion;

an L-shaped first-conductor-portion that is electrically connected to the central conductor at the end portion of the coaxial cable; and an L-shaped second-conductor-portion that is electrically connected to the outer conductor at the end portion of the coaxial cable and disposed along an outer circumferential face of the coaxial cable, the first and second conductor portions as a whole being formed into an approximate U-shape.

2. The antenna device according to claim 1, wherein the first conductor portion is formed by exposing the central conductor of the coaxial cable by a predetermined length and folding the central conductor into the L-shape.

3. The antenna device according to claim 1, wherein the second conductor comprises an L-shaped metal-sleeve which covers the outer circumferential face of the end portion of the coaxial cable.

4. The antenna device according to claim 1, wherein the coaxial cable is disposed on a substrate, and the first conductor portion is formed from an L-shaped first-wiring-pattern formed on the substrate, and the second conductor portion is formed from an L-shaped second-wiring-pattern formed on the substrate.

5. An antenna device comprising:

a substrate;

an L-shaped first-wiring-pattern formed on the substrate;

an L-shaped second-wiring-pattern which has an end opposed to an end of the first wiring pattern with clearance and is formed such that it forms an approximate U-shape on the substrate together with the first wiring pattern;

an L-shaped ground-pattern which has one end electrically connected to the end of the second wiring pattern and is formed inside the second wiring pattern with a space and along the second wiring pattern on the substrate; and an L-shaped signal-pattern which has one end electrically connected to the end of the first wiring pattern and is formed inside the ground pattern with a space and along the ground pattern on the substrate.

6. The antenna device according to claim 5, further comprising a coaxial cable having a central conductor and an outer conductor, wherein at an end of the coaxial cable, the central conductor is connected to the other end of the signal pattern, and the outer conductor is connected to the other end of the ground pattern.

7. The antenna device according to claim 2, wherein the second conductor comprises an L-shaped metal-sleeve which covers the outer circumferential face of the end portion of the coaxial cable.

* * * * *